US005373946A

United States Patent [19]

Olivier

[11] Patent Number: 5,373,946

[45] Date of Patent: Dec. 20, 1994

[54] SYSTEM FOR MEDIA SEPARATION OF SOLID PARTICLES

[76] Inventor: Paul A. Olivier, Kortemarkstraat, 159 B - 8610 Handzame, Belgium

[21] Appl. No.: 993,857

[22] Filed: Dec. 21, 1992

[51] Int. Cl.[5] ..... B03B 5/42

[52] U.S. Cl. ..... 209/172.5; 209/452

[58] Field of Search ..... 209/16, 155, 157, 172, 209/172.5, 173, 451, 452

[56] References Cited

U.S. PATENT DOCUMENTS

| | | | |
|---|---|---|---|
| 1,559,938 | 11/1925 | Chance . | |
| 2,298,016 | 10/1942 | Lincoln | 209/452 |
| 3,815,737 | 6/1974 | Katter | 209/452 X |
| 4,234,415 | 11/1980 | Casuso | 209/172.5 |
| 4,323,449 | 4/1982 | Pelletier | 209/452 X |
| 5,169,005 | 12/1992 | Beane | 209/172.5 |

FOREIGN PATENT DOCUMENTS

| | | | |
|---|---|---|---|
| 0156283 | 4/1954 | Australia | 209/172.5 |
| 0212920 | 11/1955 | Australia | 209/172.5 |
| 29704 | 6/1981 | European Pat. Off. . | |
| 533027 | 2/1922 | France . | |
| 866046 | 6/1941 | France . | |
| 960801 | 3/1957 | Germany . | |
| 3132162 | 3/1983 | Germany . | |
| 2053737 | 2/1981 | United Kingdom | 209/172.5 |

*Primary Examiner*—D. Glenn Dayoan
*Assistant Examiner*—Tuan N. Nguyen
*Attorney, Agent, or Firm*—Sughrue, Mion, Zinn, Macpeak & Seas

[57] ABSTRACT

A system for separating solid particles in two fractions by means of a medium, the specific gravity of said medium being between the specific gravity of the particles of the first fraction and the specific gravity of the particles of the second fraction. The preferred system having: a scrolled barrel made of a central mid-section in which the separation takes place; a device associated with the barrel for driving it rotatively along its longitudinal center line; mechanisms for feeding or injecting into the barrel both the solid particles to be separated and also the medium effecting this separation; a mechanism for removing the sink fraction from the central mid-section, this mechanism made of a scrolled cone, the lower end of the scrolled cone being attached to the central mid-section and having a diameter somewhat larger than the diameter of the central mid-section, while the higher end has a relatively smaller diameter through which the sinks are discharged; a mechanism for removing the float fraction from the central mid-section, and made of a cone whose lower end is attached to the central mid-section, while the higher discharge end serves as the point of overflow for the medium and float particles; and a mechanism to prevent the float particles from crossing over into the sink's cone and thus reporting with the sink particles. The invention also relates to an assembly of barrels for such a system and to a process for media separation.

13 Claims, 6 Drawing Sheets

1
2
3
5
6
8
9
10
15
17
18
24
25
26
30
33
35
36
37
50
55
71
101
129
341
A
B
C
D
E
F
G
L
P
Q
X
Y
d
α
I
II
IV
V
VI

SYSTEM FOR MEDIA SEPARATION OF SOLID PARTICLES

The preferred system comprises 1. a scrolled barrel consisting of a central mid-section in which the separation takes place;

2. a means associated with said barrel for driving it rotatively along its longitudinal center line;

3. means for feeding or injecting into the barrel both the solid particles to be separated as well as the medium effecting this separation;

4. a means for removing the sink fraction from said central mid-section, this means consisting preferrably of a scrolled cone, the lower end of said scrolled cone is attached to the central mid-section and has a diameter somewhat larger than the diameter of said central mid-section, while the higher end has a relatively smaller diameter through which the sinks are discharged;

5. a means for removing the float fraction from the central mid-section, this means consisting preferrably of a cone, the lower end of said cone is attached to the central mid-section, while the higher discharge end serves as the point of overflow for the medium and float particles;

6. a means to prevent the float particles from crossing over into the sinks cone and thus reporting with the sink particles.

The invention also relates to an assembly of barrels for such a system and to a process for media separation.

THE PRIOR ART

Heavy media separation generally involves the immersion of a raw product in a fairly quiescent fluid having a density intermediate between the densities of the two fractions to be separated. Even though heavy media vessels come in many sizes, shape, and capacities, the basic principle of separation remains the same upon immersion into the separatory fluid, the less dense fraction floats whereas the more dense fraction sinks. Barrels, cones, cylinders, and rectangular baths have all served as heavy media separatory vessels. However the most common vessel shape within heavy media separation is that of a horizontal scrolled barrel.

Scrolled barrels may be generally classified as mono- or bi-directional. Mono-directional barrels are constructed in such a manner that both the floats and the sinks move in the same direction and exit on the same end of the barrel. Bi-directional barrels have floats and sinks moving in opposite directions relative to one another, and consequently the floats and sinks each exit at opposite ends of the barrel. In a bi-directional barrel the floats at the surface of the bath stream across the length of the barrel mid-section until they reach their point of overflow at the discharge end of the floats overflow cone, whereas the sinks at the bottom of the bath are screwed in the opposite direction by means of scrolls until they reach the discharge end of the sinks evacuation cone.

The large majority of heavy media barrels on the market today are mono-directional, whereas only a small percentage of barrels are bi-directional. On certain materials, bi-directionality has its distinct advantages, and the present patent relates only to bi-directional barrels.

In a bi-directional barrel the raw feed is introduced near the place where the sinks are evacuated. In this case, the only practical way of evacuating the sinks is by means of a scrolled cone. But all such bi-directional barrels with sink evacuation cones are faced with a very annoying problem which up to now has never been solved in a satisfactory way: namely, how to pervent a small percentage of floats from working their way toward the sinks side of the barrel and eventually reporting with the sinks being screwed up the sinks evacuation cone.

One solution to this problem involves injecting medium at various points in the sinks evacuation cone so as to flush back down into the barrel any floats that tend to work their way toward the sink side of the barrel. Another solution involves two curtains or barriers running the full length of the central barrel mid-section. These curtains are designed to prevent floats from getting caught up in the barrel scrolls and thus working their way toward the sink side of the barrel. Both of these solutions fail to assure a relatively perfect segregation of floats from sinks.

A BRIEF DESCRIPTION OF THE INVENTION

Heavy media separation generally involves the immersion of a raw product in a fairly quiescent fluid having a density intermediate between the densities of the two fractions to be separated. Upon immersion into the separatory fluid, the less dense fraction floats whereas the more dense fraction sinks. This patent relates to heavy media scrolled barrels, and more specifically to heavy media bi-directional scrolled barrels. It assures that particles which float on the surface of a heavy media bi-directional barrel do indeed report to the float side of this barrel and in no way have the possibility of reporting incorrectly to the opposite sink side of said barrel.

The system according to the present invention is a system for separating solid particles in two fractions by means of a medium, the specific gravity of said medium situating inbetween the specific gravity of a first fraction—namely the float fraction—and the specific gravity of the second fraction—namely the sink fraction. Said system comprises:

a) a first scrolled barrel in which the separation takes place, said barrel stretching between two open ends;

b) a means for feeding into said barrel the solid particles to be separated and the medium;

c) a means associated with said first barrel for evacuating the sink fraction through an opening, said means being located at a first open end of said first barrel;

d) a point of discharge associated with said first barrel for evacuating the float fraction as well as medium, said point of discharge being located at the other open end of said first barrel; and e) a means associated with said first barrel for turning it rotatively along a longitudinal axis, such rotative movement serving to scroll the sink fraction towards the first open end of said first barrel.

In said system, the means for evacuating the sink fraction is comprised of a second scrolled barrel attached to and communicating with said first barrel, said second barrel having at its end adjacent to said first barrel an inner diameter greater than the inner diameter of that end of first barrel adjacent to said second barrel.

The system is also provided with a means to prevent float particles from crossing into that part of said second barrel located between said means and the opening for removing the sink fraction.

Advantageously, the means to prevent float particles from crossing into said second barrel is a barrier whose upper edge is at a level higher than the point of discharge of the first barrel and whose lower edge permits the passage of the sink particles into the second barrel.

Preferably, the means for preventing float particles from crossing into said second barrel consists of a curtain having an upper edge, a lower edge and lateral edges, the upper edge being at a level higher than the point of discharge of the first barrel and the lower edge permitting the passage of the sink particles into the second barrel, while the lateral edges encloses a section of the outer edge of the first barrel, such enclosure preventing float particles in the first barrel from crossing into the second barrel.

According to an embodiment of the system, the means for preventing float particles from crossing into the part of said second barrel located between said means and the opening for evacuating the sink fraction consists of a curtain having an upper edge, a lower edge and two lateral edges; the upper edge being at the level higher than the point of discharge of the first barrel, the lower edge extending down into the medium but never so far as to block the passage of the sink fraction from the first barrel into the second barrel, and the two lateral edges each being inserted relative to a flanged surface which lies outside the working area of the scrolls of the first barrel yet inside the working area of the scrolls of the second barrel, and which surface lies between the upper and lower edges of said curtain.

In said embodiment, each end of the lateral edges of the curtain is advantageously adjacent to a part of the surface of the flange linking the first barrel to the second barrel.

According to a particularity of said embodiment, the lateral edge of said curtain bears an elastomeric material which is directed towards the flanged surface linking the first barrel to the second barrel.

The curtain is advantageously held in place by the means for feeding solid particles and/or medium into the first barrel and is provided with means for supplying medium into the first barrel, such as pipes for injecting medium into the first barrel and for directing said medium towards the end of the first barrel opposite to the end adjacent to the second barrel.

According to another embodiment of the system according to the invention, the first barrel is cylindrical while the second comprises a part with an inner space, the shape of which is a truncated cone, stretching between two ends, the diameter of the end adjacent to the first barrel being greater than the diameter at the other end. The central axis of said first and second barrels, which is preferably the rotational axis, forms an angle less than ten degrees with the horizontal.

According to a characteristic of an embodiment, the first barrel, at its end opposite to the end adjacent to the second barrel, is provided with a further third barrel having an inner space which bears the shape of a truncated cone stretching between two ends, the diameter of the end adjacent to the first barrel being greater than the diameter at the other end. Said other end acts as a discharge for evacuating the float fraction and a part of the medium.

The invention relates also to an assembly of barrels for a system according to the invention. Said assembly comprises a first scrolled barrel attached to and communicating with a second scrolled barrel, said second barrel having at its end adjacent to said first barrel an inner diameter greater than the inner diameter of that end of the first barrel adjacent to said second barrel.

The invention relates as well to a process for separating solid particles in two fractions by means of a medium, the specific gravity of said medium situating inbetween the specific gravity of a first fraction, namely the float fraction, and the specific gravity of the second fraction, namely the sink fraction.

In said process the solid particles to be separated as well as medium are fed into a scrolled barrel wherein said particles are separated into a float fraction and a sink fraction. The float fraction as well as medium stream towards one end of the scrolled barrel, while at the same time the scrolled barrel is rotated so as to move the sink fraction towards the opposite end of the scrolled barrel and furthermore so as to bring said sink fraction into a second scrolled barrel attached to and communicating with the first barrel. A curtain is preferably positioned at or near the junction of the two barrels; that is, between that end of the first barrel nearest to the second barrel and that end of the second barrel nearest to the first barrel. Said curtain serves to prevent the passage of the float fraction into that part of the second barrel located between said curtain and the end opposite to the end adjacent to the first barrel. The float fraction as well medium is evacuated at the end of the first barrel opposite to the end adjacent to the second barrel, while, as a result of the rotation of the second barrel, the sink fraction is evacuated at the end of the second barrel opposite to the end adjacent to the first barrel.

In said process, preferably at least one parameter selected from among the group consisting of the speed of rotation of the barrels, the density of the medium, the viscosity of the medium, the feed rate of medium into the first or second barrels, the feed rate of solids into the first barrel, etc., is controlled so as to obtain a sink fraction containing less than 0.01% by weight of particles having a specific gravity lower than the specific gravity of the medium and at the same time to obtain a float fraction containing less than 0.01% by weight of particles having a specific gravity higher than the specific gravity of the medium.

DESCRIPTION OF THE PREFERRED EMBODIMENT

Figure 1:
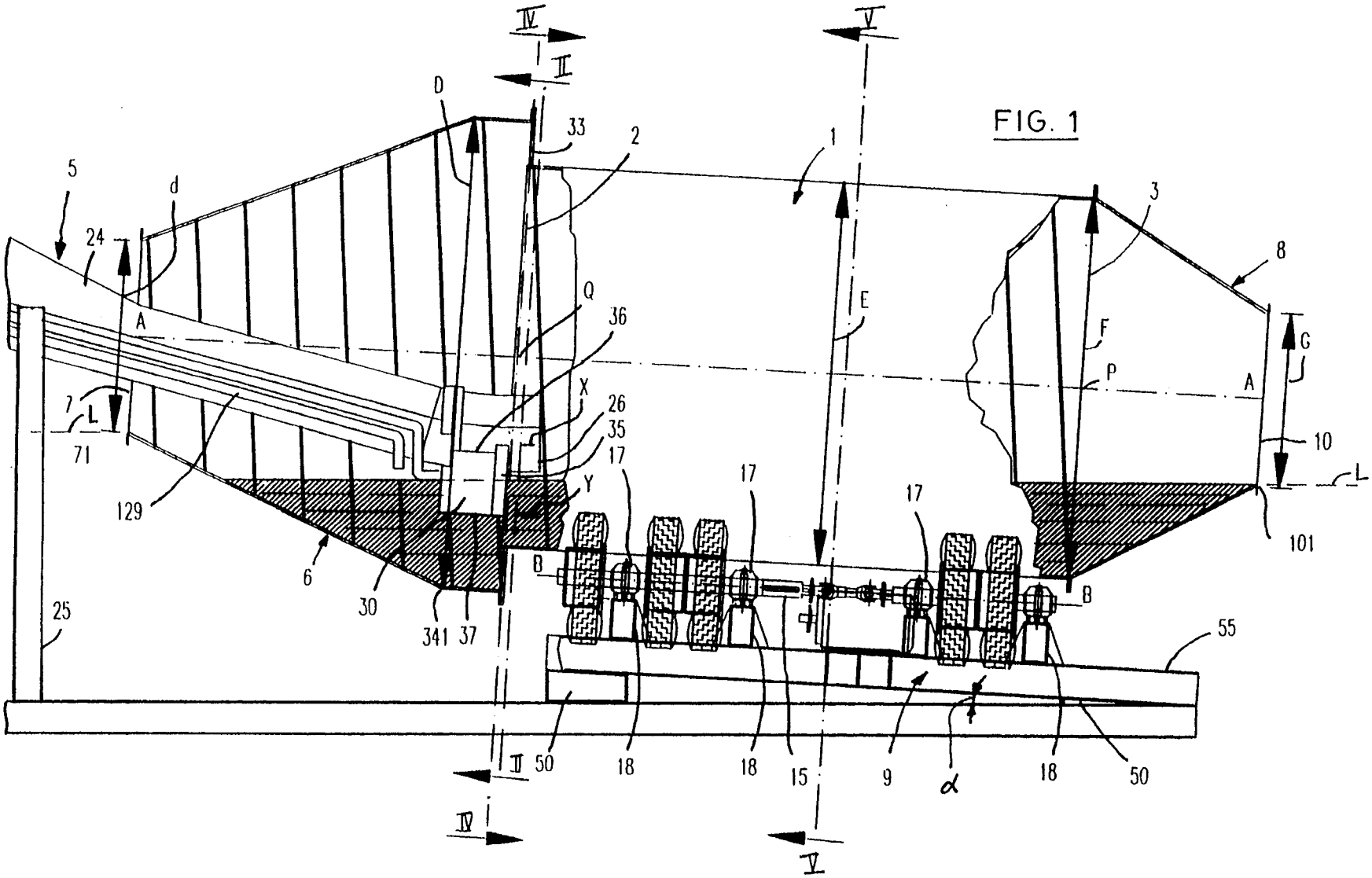
FIG. 1 is a side view with cross-sections of a system according to the invention.
Figure 2:
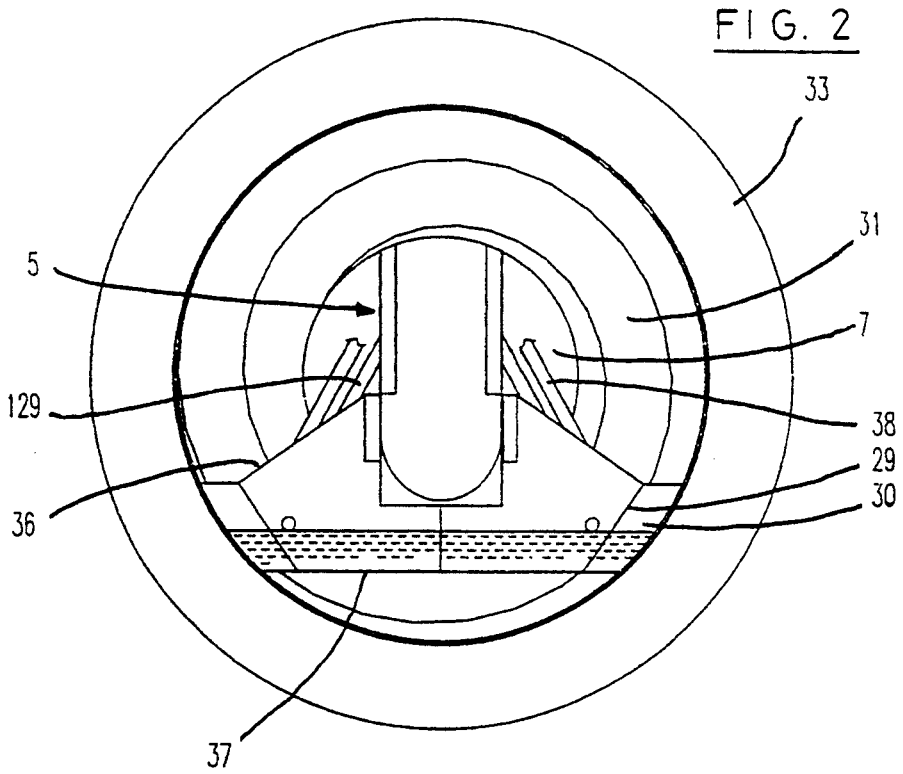
FIG. 2 is a view along line II—II of the system shown in FIG. 1.
Figure 4:
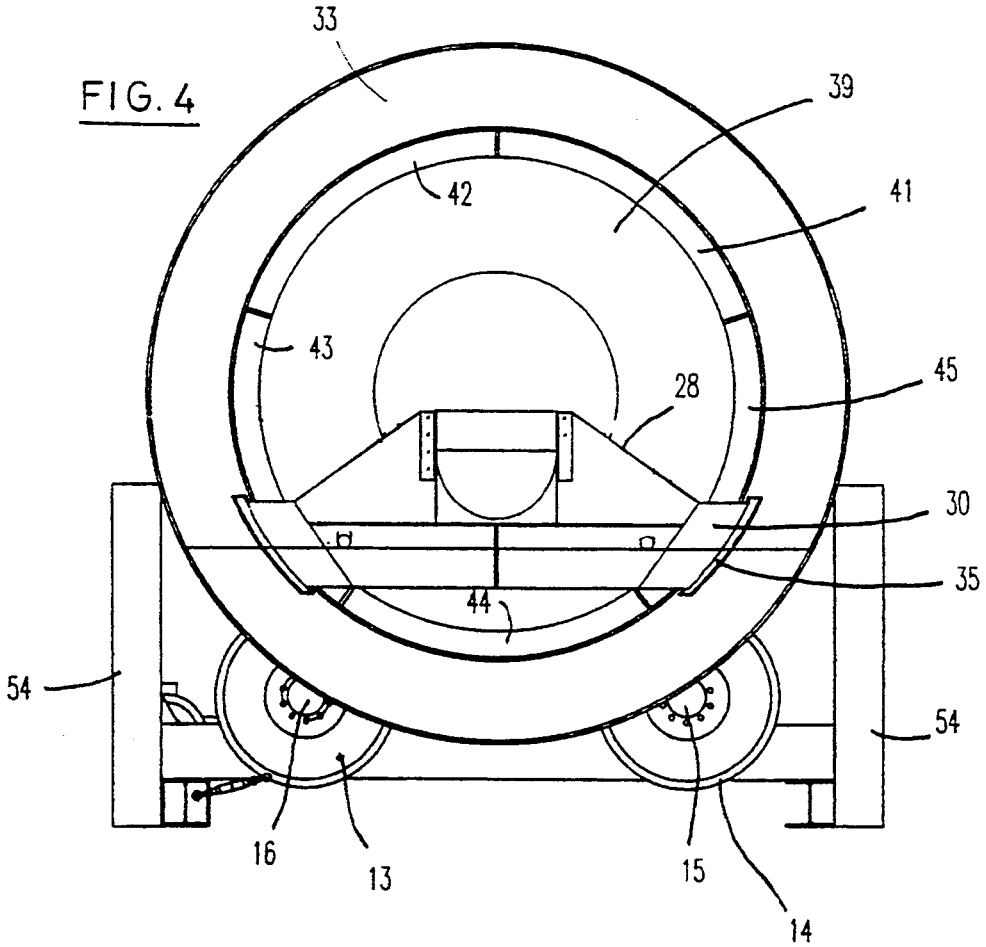
FIG. 4 is a view along the line IV—IV of the system shown in FIG. 1.
Figure 3:
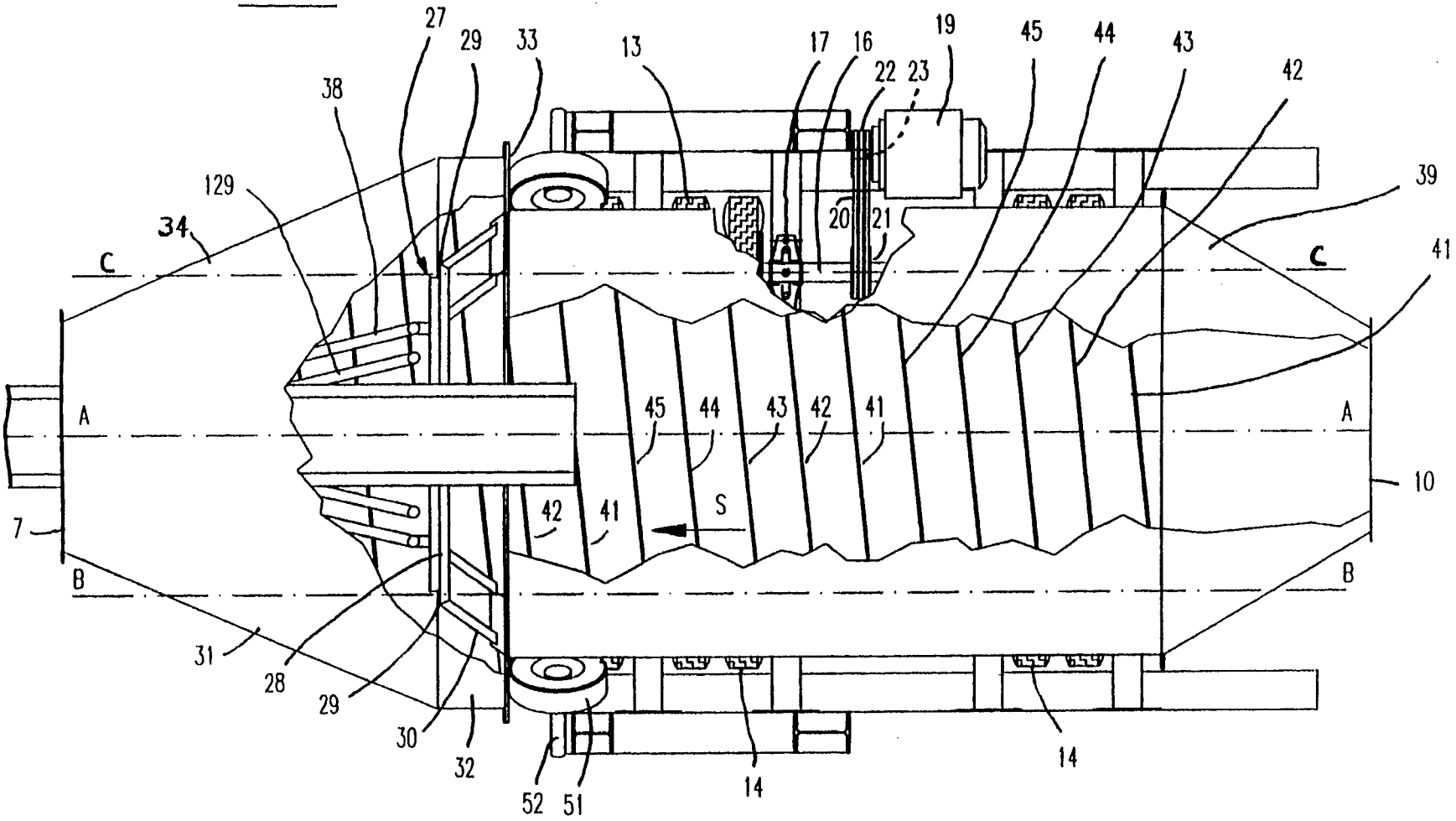
FIG. 3 is a top view with cross-sections of the system shown in FIG. 1.
Figure 5:
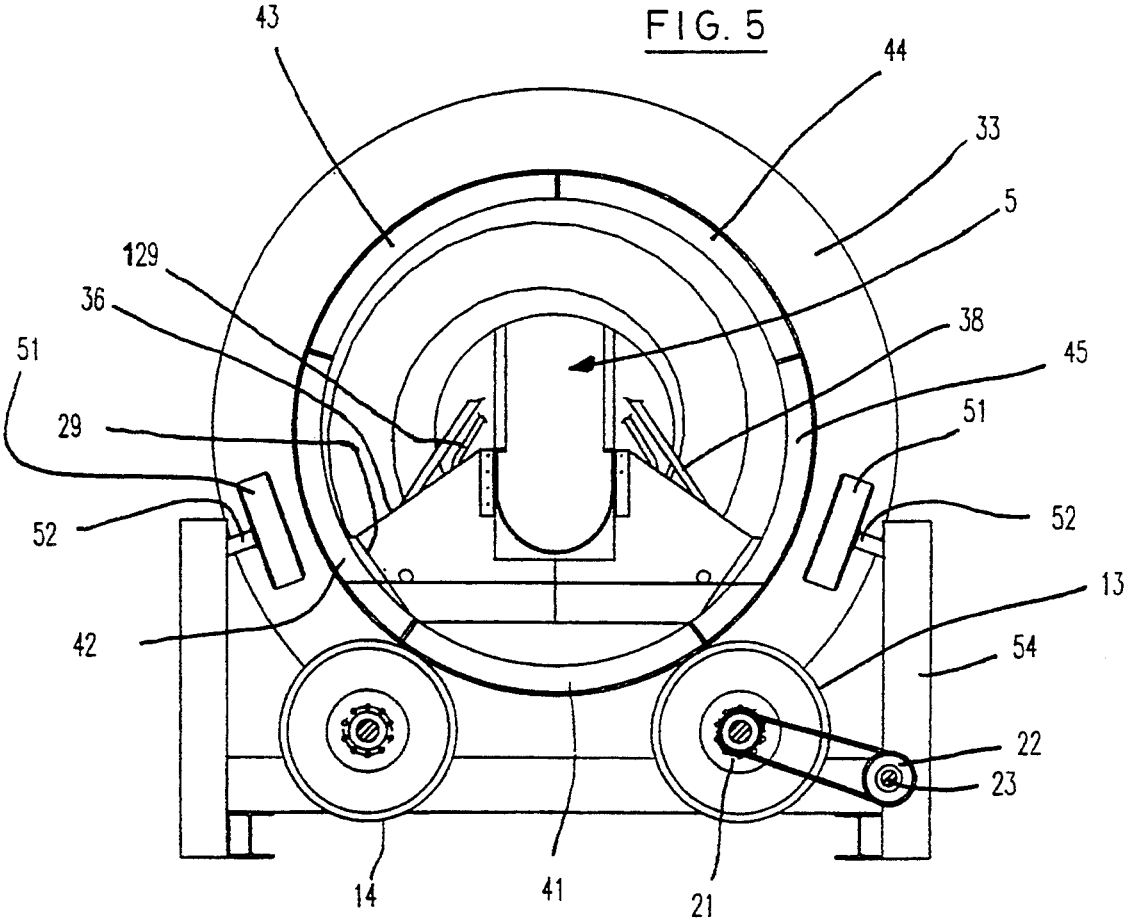
FIG. 5 is a view along the line V—V of the system shown in FIG. 1.

FIG. 1 shows a system for separating solid particles in two fractions by means of a medium, the specific gravity of which being comprised between the specific gravity of a first fraction—the floating fraction, and the specific gravity of the second fraction—the sinking fraction.

The preferred system comprises:

(a) a first longitudinal scrolled barrel 1 in which the separation takes place, said barrel stretching between a first open end 2 and a second open end 3 and being provided with five scrolls 41, 42, 43, 44, 45 having a right-handed pitch, (b) means 5 for feeding a mixture medium and solid particles to be separated, (c) means 6 for evacuating through an opening 7 the sink fraction out of the system, (d) a discharge 8 associated with said barrel 1 for removing through an opening 10 the float fraction as well as the medium, (e) means 9 associated with said barrel 1 for driving it rotatively along a longitudinal axis A—A.

The opening 10 of the discharge 8 has a lower edge 101 located at a level L lower than the level L of the lower edge 71 of the opening 7 for the removal of the sink fraction.

The means 9 rotates clockwise R1 the barrel 1 so as to ensure the movement of the sink fraction towards the means for removing the sink fraction (arrow S).

The barrel 1 is supported by 12 pneumatic wheels 13, 14, six wheels 13 being located on the left side of the barrel 1, while the six other wheels 14 being located on the right side of barrel 1.

Said wheels 13, 14 are mounted on shafts 15, 16, the axis B—B; C—C of which are parallel to the central axis A—A of the barrel 1. Said shafts are held in place by ball bearings 17 located at the free end of uprights 18. Shaft 16 is driven by a motor 19, such as an electrical motor or a diesel motor, via pulley 20 connecting sheave 21 secured on shaft 16 with sheave 22 secured on shaft 23 of the motor 19. Due to the rotation of the shaft 23 of the motor 19, wheels 13 are driven so that due to the friction of said wheels 13 on barrel 1, the latter is turned along its longitudinal axis A—A. The means 5 for feeding the mixture of medium and solid particles to be separated consists of an injector 24 held in position by structure 25. This injector 24 is inclined so that particles present in said injector 24 move in the direction of barrel 1. The free end 26 of said injector 24 is within the inner separatory space of the barrel 1. Near to this free end 26, the injector 24 supports a curtain 27 consisting of a central plate 28 provided at each of its lateral edges 29 with a section 30 directed towards that end of barrel 31 connecting to barrel 1.

Like barrel 1, barrel 31 is scrolled. Said barrel 31 attaches to and communicates with barrel 1, thereby acting as means 6 for evacuating the sink fraction. Said second barrel 31 comprises: a first cylinder part 32 attached by means of a flange 33 to the cylindrical barrel 1 and a second part 34 with an inner space having the shape of a truncated cone. Said cone stretches between two ends 7, 341. The diameter D of the cross-section of the cone 34 at its end 341 adjacent to the first barrel 1 is greater than the diameter d of the cross-section of said cone 34 at its other end 7. Said diameter D corresponds to the diameter of the inner cross-section of the cylindrical part 32 which is greater than the diameter E of the inner cross-section of barrel 1. Said diameter D is advantageously greater than $1.1 \times E$, and is preferably comprised between $1.15 \times E$ and $1.25 \times E$.

In the preferred embodiment as shown, the central axis of the second barrel 31 corresponds to the central axis of the first barrel 1 and is the rotation axis of said barrels.

The sections 30 of the curtain 27 are provided at their lateral free ends with a layer 35 of an elastomeric material. Said layers 35 are in very close proximity to a part of the flange 33 which creates the junction between the first barrel 1 and the second barrel 31.

The upper edge 36 of curtain 27 is at a level X higher than the level L of the point of discharge 10 of the float fraction and the medium while the lower edge 37 of curtain 29 is at a level Y permitting the passage of said sink fraction from barrel 1 to the opening 7 for the evaluation of the sink fraction.

Said curtain 29 acts therefore as a means to prevent float particles from crossing into the part of said second barrel located between said means and the opening for removing the sink fraction.

In order to ensure that float particles near the curtain 29 will move towards the opening 10 through barrel 1, the curtain 29 features pipes 38 for supplying medium in the neighborhood of the curtain 29 and on the side adjacent to the first barrel 1.

In order to ensure a good separation that only sink particles pass underneath the curtain 27, medium is advantageously fed through pipe 129 into that part of barrel 6 located between the opening 7 and the curtain 27. In this way a flow of medium underneath the curtain from its sink side to its float side can be created.

The first scrolled barrel 1 is provided at its end 3 opposite to the end 2 adjacent to the second scrolled barrel 31 with a third barrel 39 which does not have any scrolls. Said third barrel 39 has an inner space having the shape of a truncated cone. Said third cone 39 is attached to and communicates with the first barrel 1.

Said barrel 39 stretches between two ends, the diameter F of the cross-section of the cone at its end adjacent to the first barrel 1 being greater than the diameter G of the cross-section of the cone at its other end. Said barrel 39 has a central axis which corresponds to the central axis A—A of the barrel 1.

Openings 7 and 10 constitute respectively the discharge for the sink fraction and the discharge for the float fraction.

The central axis A—A of the barrels forms advantageously an angle from 1° to 10°; for example, 5° with the horizontal. In order to obtain said inclination, blocks 50 are placed under the support 55 of the system. The inclination is such that the level P of the axis at the end of the barrel 1 adjacent to the barrel 39 is lower than the level Q of the axis at the end of the barrel 1 adjacent to the barrel 31.

Two pneumatic wheels 51 roll against the outer surface of the flange 33. Said wheels are mounted on shafts 52 supported by ball bearings secured at the end of uprights 54. The axis T of said shafts 52 stretch in a radial direction with respect to the central axis A—A of the barrels.

Due to the rotation of barrels 1, 31, the sink particles move towards opening 7 (arrow S).

The system according to the invention is ideally suited for separating particles with a size from 3 mm up to 300 mm or even more. These particles cover a broad range of materials such as non-ferrous metals, plastics, diamonds, vegetables, etc. The specific gravity of the medium may be as low as 1.0 and as high as 3.5. The actual medium is usually water-based with very fine colloidal particles in suspension. Suspension-creating materials such as clay, sand, magnetite, and ferrosilicon are typically used.

After filling the barrels with medium up to the level L, a mixture of medium and solid particles are covered into the barrel 1 by means of an injector 24. The particles are separated in said barrel 1 into a float fraction and a sink fraction. The barrels are rotated so that due to the rotative screwing effect of the scrolls, the sink fraction is moved towards the opening 7 of barrel 31. More specifically, the sink fraction falls from barrel 1 into barrel 31 and from there it exits through opening 7. The evacuation of the sink fraction does not influence the medium in barrel 1. The curtain 29 blocks float particles from crossing over into barrel 31 and eventually from joining the sinks exiting through opening 7. Advantageously medium is injected in the neighborhood of the curtain 29 in the direction of opening 10 so as to prevent float particles from congregating near the curtain 29.

Many parameters may be controlled so as to obtain a satisfactory separation; the speed of rotation of the barrels, the density and viscosity of the medium, the feed rate of medium into the first or second barrels, the feed rate of solids into the first barrel, etc. The curtain 29 assures that no float particles will report with the sink particles being evacuated through opening 7. More specifically, the curtain 29 assures that the precentage of floats in sinks will not be greater than the percentage of sinks in floats, and that, under normal operating conditions, it becomes feasible to obtain a sink fraction containing less than 0.01% by weight of particles having a specific gravity lower than the specific gravity of the medium and at the same time to obtain a float fraction containing less than 0.01% by weight of particles having a specific gravity higher than the specific gravity of the medium.

A prototype of the system according to the invention was built. With respect to this prototype as represented in FIG. 1, the characteristics of barrel 1 were as follows: diameter E approximately 2.4 meters, diameter D approximately 3.0 meters, diameter d approximately 1.25 meters, diameter G approximately 1.1 meters. The length of barrel 1 was approximately 4.0 meters, while the length of barrel 6 was approximately 2.0 meters and the length of barrel 8 was approximately 1.0 meters. The angle $\alpha$ was approximately 3° degrees. The pitch of the scrolls was 1.5 meters, and the number of scrolls was five. The speed of rotation of the barrels was varied from 6 to 12 rpm. Fifty tons per hour of non-ferrous metal particles were fed to the barrels, of which approximately 50% were floats and 50% were sinks. The medium consisted of water and atomized ferrosilicon. The specific gravity of separation was approximately 2.20. Samples of both floats and sinks were collected over a two-week period, and after analysis they were found to be without any trace of misplaced material.

Figure 6A:
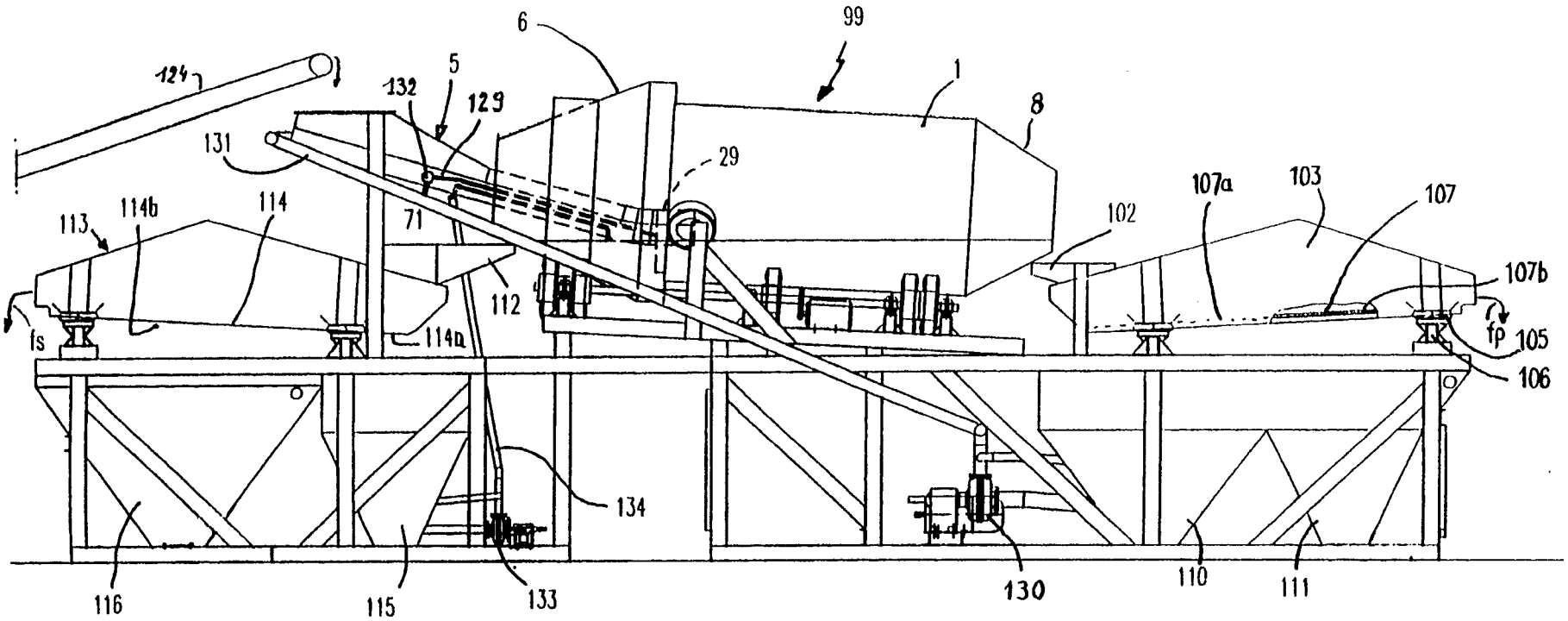
FIGS. 6A, 6B are schematic views of a plant using an embodiment of the system shown in FIG. 1.
Figure 6B:
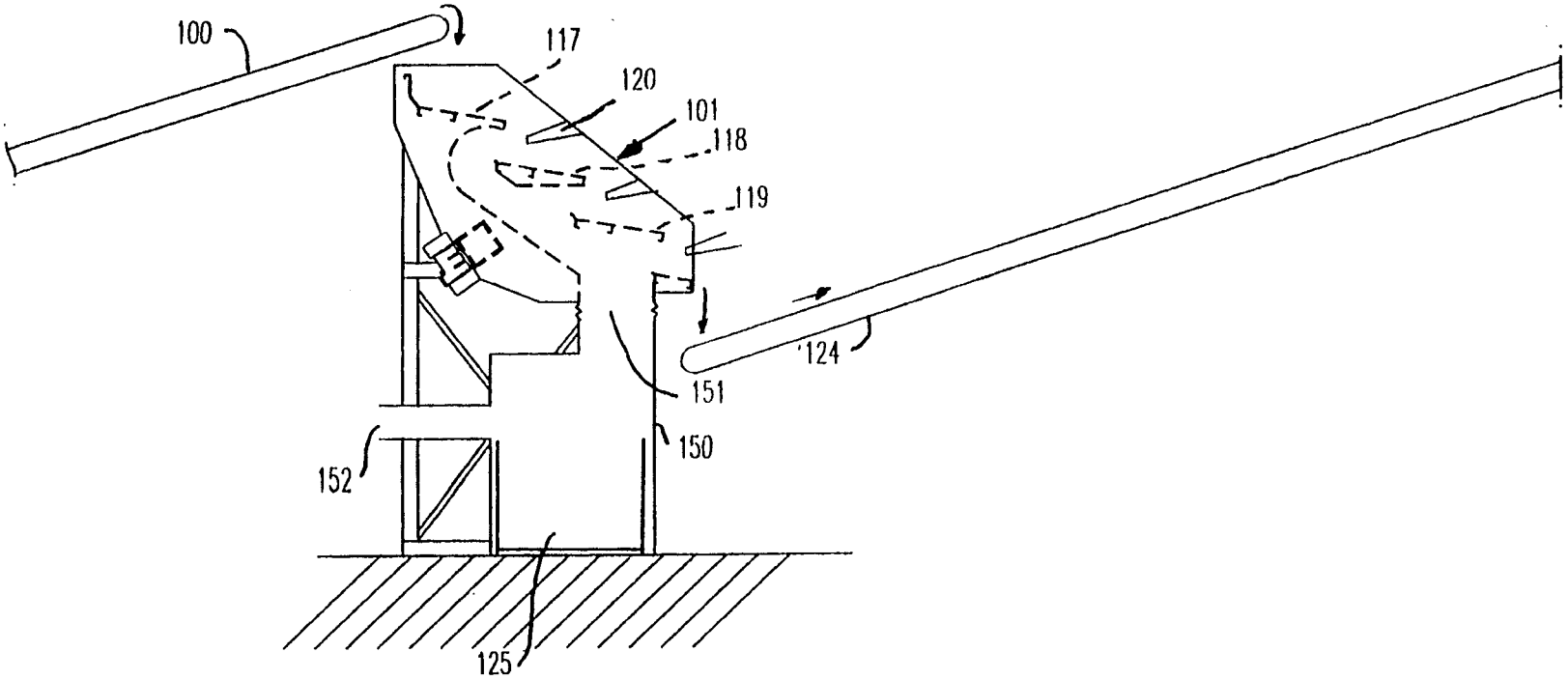

FIG. 6 is a schematic view of a plant using an embodiment of a system according to the invention. Said plant comprises:

(a) a conveyor belt 100 for feeding a mixture of solid particles to be treated, said mixture coming a fragmentizer, for example, as in the case of a non-ferrous metal application.

(b) an air separator 101 for treating the particles coming from conveyor belt 100. The function of this air separator, for example, as in the case of a non-ferrous metal application, is to remove very light porous material, fabric textiel foam, simulated leather, dust and other such materials which should not enter into the dense medium circuit.

(c) the system according to the invention (indicated by 99) in which the particles free from this undesirable light fraction are fed together with the medium through means (injector) 5 and in which said particles are separated into a sink fraction and a float fraction.

(d) a chute 102 for collecting medium as well as float particles and for distributing them on a vibratory screen 103.

(e) a vibratory screen 103 supported by air cushions 105 which in turn are supported by a steel structure 106, said vibratory screen 103 consisting of a first section known as a dewatering section **107*a* and a second section known as rinse section 107*b***.

(f) a medium tank 110 for collecting the medium flowing through the first section **107*a* of the vibratory screen 103**.

(g) a rinse tank 111 for collecting the rinse water flowing through the second section **107*b* of the vibratory screen 103**.

(h) a chute 112 for collecting medium as well as sink particles and for distributing them on a vibratory screen 113.

(i) a vibratory screen 113 supported by air cushions 105 which in turn are supported by a steel structure 106, said vibratory screen 113 consisting of a first section known as a dewatering section **114*a* and a second section known as rinse section 114*b***.

(j) a medium tank 115 for collecting the medium flowing through the first section **114*a* of the vibratory screen 113**.

(k) a rinse tank 116 for collecting the rinse water flowing through the second section **114*b* of the vibratory screen 113**.

The float particles on screen 103 travel first over the dewatering section **107*a* and then over the rinse section 107*b*, and finally they exit screen 103 at that end opposite chute 102 (cf arrow fp), whereas the sink particles on screen 113 travel first over the dewatering section 114*a* and then over the rinse section 114*b*, and finally they exit screen 113 at that end opposite chute 112** (cf arrow fs).

Part of the medium collected in tank 110 is injected through pipe 131 into barrel 1 by means of the injector 5. A second part of said medium is injected through pipes 38 on the float side of the curtain 29 to prevent the accumulation of floats near the curtain. Finally a third part of said medium is injected through pipe 129 on the sink side of the curtain 29 so as to create a flow of medium underneath the curtain from its sink side to its float side. These three parts of the medium in tank 110 are all pumped out of said tank by means of the primary medium pump 130. In this way the primary medium pump 130 also restores to the system the medium overflowing barrel 8.

A regulation system such as a valve 132 is mounted on pipe 129 so as to regulate the flow of medium underneath the curtain 29 from its sink side to its float side. This assures that only sink particles pass underneath the curtain to its sink side.

The medium collected in tank 115 is pumped by means of the secondary medium pump 133 through pipe 134 into the second barrel 6 so as to restore to said barrel the medium being screwed out together with the sink particles.

The apparatus 101 comprises a series of trays, such as descending, cascading, vibratory trays 117, 118, 119. As the particles drop from one tray to the next, they are subjected to a current of air so as to deflect the lighter particles of dust textile, and foam, as in the case of a non-ferrous metal application for example, from the heavier particles which are then to report for further separation to the system according to the invention 99. The current of air is produced by means of an air injection system comprised for example of special air nozzles 120 which in turn are fed by a ventilator. According to a preferred embodiment, each tray has its own air nozzle and each air nozzle has an opening whose length corresponds to the width of the tray. As soon as the particles to be separated fall from a particular tray they are immediately subjected to a current of air deflecting the lighter particles in a direction generally opposite to the movement of the heavier particles on the trays. The light particles are deflected in such a manner that they are no longer able to fall back onto a tray, and they fall instead into a collection bin 125 situated generally underneath the trays. The collection bin 125 is situated in a sealed housing 150 which communicates through an opening 151 to the tray system 101 and which communicates as well as through an opening 152 to the ventilator which feeds the air nozzles. Preferably an air filtration unit is incorporated into the circuit.

What I claim is:

1. A system for separating solid particles in two fractions by means of a medium, the specific gravity of said medium situating inbetween the specific gravity of the first fraction—namely the float fraction—and the specific gravity of the second fraction—namely the sink fraction—said system comprising:

a) a first scrolled barrel in which the separation takes place, said barrel stretching between two open ends;

b) means for feeding into said barrel the solid particles to be separated and the medium;

c) means associated with said first barrel for evacuating the sink fraction through an opening, said means being located at a first open end of said first barrel;

d) a means associated with said first barrel for discharging or evacuating the float fraction as well as medium, said point of discharge being located at the other open end of said first barrel;

e) means associated with said first barrel for turning it rotatively along a longitudinal axis, such rotative movement serving to scroll the sink fraction towards the first open end of said first barrel;

in which:

the means for evacuating the sink fraction is comprised of a second scrolled barrel attached to and communicating with said first barrel, said second barrel having at its end adjacent to said first barrel an inner diameter greater than the inner diameter of that end of the first barrel adjacent to said second barrel, and the system is provided with a means to prevent float particles from crossing into the part of said second barrel located between said means and the opening for removing the sink fraction, said means consisting of a curtain having an upper edge, a lower edge and lateral edges, the upper edge being at a level higher than the point of discharge of the first barrel and the lower edge being at a level permitting the passage of the sink particles into the second barrel, while the lateral edges encloses a section of the outer edge of the first barrel, such enclosure preventing float particles in the first barrel from crossing into the second barrel, and the first barrel is cylindrical while the second comprises a part with an inner space, the shape of which is a truncated cone, stretching between two ends, the diameter of the end adjacent to the first barrel being greater than the diameter at the other end and in which the central axis of said first and second barrels forms an angle less than ten degrees with the horizontal.

2. A system for separating solid particles in two fractions by means of a medium, the specific gravity of said medium situating inbetween the specific gravity of a first fraction—namely the float fraction—and the specific gravity of the second fraction—namely the sink fraction—said system comprising:

a) a first scrolled barrel in which the separation takes place, said barrel stretching between two open ends;

b) means for feeding into said barrel the solid particles to be separated and the medium;

c) means associated with said first barrel for evacuating the sink fraction through an opening, said means being located at a first open end of said first barrel;

d) a means associated with said first barrel for discharging or evacuating the float fraction as well as medium, said point of discharge being located at the other open end of said first barrel;

e) means associated with said first barrel for turning it rotatively along a longitudinal axis, such rotative movement serving to scroll the sink fraction towards the first open end of said first barrel;

in which:

the means for evacuating the sink fraction is comprised of a second scrolled barrel attached to and communicating with said first barrel, said second barrel having at its end adjacent to said first barrel an inner diameter greater than the inner diameter of that end of the first barrel adjacent to said second barrel, the system is provided with a means to prevent float particles from crossing into the part of said second barrel located between said means and the opening for removing the sink fraction, said means consisting of a curtain having an upper edge, a lower edge and lateral edges, the upper edge being at the level higher than the point of discharge of the first barrel and the lower edge being at a level permitting the passage of the sink fraction while the lateral edges of the curtain have an end which is adjacent to a part of a surface adjacent to the junction of the first barrel with the second barrel, and in which the first barrel is cylindrical while the second comprises a part with an inner space, the shape of which is a truncated cone, stretching between two ends, the diameter of the end adjacent to the first barrel being greater than the diameter at the other end and in which the central axis of said first and second barrels forms an angle less than ten degrees with the horizontal.

3. A system for separating solid particles in two fractions by means of a medium, the specific gravity of said medium situating inbetween the specific gravity of a first fraction—namely the float fraction—and the specific gravity of the second fraction—namely the sink fraction—said system comprising:

a) a first scrolled barrel in which the separation takes place, said barrel stretching between two open ends;

b) means for feeding into said barrel the solid particles to be separated and the medium;

c) means associated with said first barrel for evacuating the sink fraction through an opening, said means being located at a first open end of said first barrel;

d) a means associated with said first barrel for discharging or evacuating the float fraction as well as medium, said point of discharge being located at the other open end of said first barrel;

e) means associated with said first barrel for turning it rotatively along a longitudinal axis, such rotative movement serving to scroll the sink fraction towards the first open end of said first barrel;

in which:

the means for evacuating the sink fraction is comprised of a second scrolled barrel attached to and communicating with said first barrel, said second barrel having at its end adjacent to said first barrel an inner diameter greater than the inner diameter of that end of the first barrel adjacent to said second barrel, and the system is provided with a means to prevent float particles from crossing into the part of said second barrel located between said means and the opening for removing the sink fraction, said means consisting of a curtain having an upper edge, a lower edge and lateral edges, the upper edge being at the level higher than the point of discharge of the first barrel and the lower edge being at a level permitting the passage of the sink fraction while the lateral edges of the curtain have an end which is adjacent to a part of a surface adjacent to the junction of the first barrel with the second barrel, and in which the first barrel is provided at its end opposite to the end adjacent to the second barrel with a third barrel with an inner space having the shape of a truncated cone stretching between two ends, the diameter of the end adjacent to the first barrel being greater than the diameter at the other end, said other end acting as a discharge for evacuating the float fraction and a part of the medium.

4. A system for separating solid particles in two fractions by means of a medium, the specific gravity of said medium situating inbetween the specific gravity of a first fraction—namely the float fraction—and the specific gravity of the second fraction—namely the sink fraction—said system comprising:

a) a first scrolled barrel in which the separation takes place, said barrel stretching between two open ends;

b) means for feeding into said barrel the solid particles to be separated and the medium;

c) means associated with said first barrel for evacuating the sink fraction through an opening, said means being located at a first open end of said first barrel, said means being comprised of a second scrolled barrel attached to and communicating with said first barrel, said second barrel having at its end adjacent to said first barrel an inner diameter greater than the inner diameter of that end of the first barrel adjacent to said second barrel;

d) a means associated with said first barrel for discharging or evacuating the float fraction as well as medium, said point of discharge being located at the other open end of said first barrel;

e) means associated with said first barrel for turning it rotatively along a longitudinal axis, such rotative movement serving to scroll the sink fraction towards the first open end of said first barrel;

f) means to prevent float particles from crossing into the part of said second barrel located between said means and the opening for removing the sink fraction, in which the first barrel is provided at its end opposite to the end adjacent to the second barrel with a third barrel with an inner space having the shape of a truncated cone stretching between two ends, the diameter of the end adjacent to the first barrel being greater than the diameter at the other end, said other end acting as a discharge for evacuating the float fraction and a part of the medium.

5. A system according to claim 4, in which the means for preventing float particles from crossing into said second barrel consists of a curtain having an upper edge, a lower edge and lateral edges, the upper edge being at a level higher than the point of discharge of the first barrel and the lower edge being at a level permitting the passage of the sink particles into the second barrel, while the lateral edges encloses a section of the outer edge of the first barrel, such enclosure preventing float particles in the first barrel from crossing into the second barrel.

6. A system according to claim 4, in which the means for preventing float particles from crossing into the part of said second barrel located between said means and the opening for evacuating the sink fraction consists of a curtain having an upper edge, a lower edge and lateral edges, the upper edge being at the level higher than the point of discharge of the first barrel and the lower edge being at the level permitting the passage of the sink fraction from the first barrel to the opening for the evacuation of the sink fraction while the lateral edges of the curtain have an end which is adjacent to a part of a surface adjacent to the junction of the first barrel with the second barrel.

7. A system according to claim 6, in which each end of the lateral edges of the curtain is adjacent to a part of the surface of the flange linking the first barrel to the second barrel.

8. A system according to claim 6, in which the curtain consists of a central plate provided at each of its lateral ends with a second directed towards the first barrel, the free end of the section adjacent to the first barrel bearing a layer of an elastomeric material.

9. A system according to claim 6, in which the curtain is supported by the means for feeding the solid particles into the first barrel.

10. A system according to claim 6, which comprises at least one pipe for feeding medium into a barrel selected from the group consisting of the first barrel and the second barrel.

11. A system according to claim 6, which comprises a means for assuring a flow of medium underneath the curtain from its sink side to its float side.

12. A system according to claim 6, which comprises a means for creating a higher pressure of the medium on that side of the curtain nearest to the point of discharge of the sink fraction.

13. A system according to claim 4, in which the first barrel is cylindrical while the second comprises a part with an inner space, the shape of which is a truncated cone, stretching between two ends, the diameter of the end adjacent to the first barrel being greater than the diameter at the other end and in which the central axis of said first and second barrels forms an angle less than ten degrees with the horizontal.

* * * * *